US005082611A

United States Patent [19]

Adams et al.

[11] Patent Number: 5,082,611

[45] Date of Patent: Jan. 21, 1992

[54] PROCESS FOR SPINNING AND DRAWING MONOFILAMENTS WITH HIGH TENACITY AND HIGH TENSILE UNIFORMITY

[75] Inventors: Earl B. Adams, Hixson; Robert K. Anderson, Signal Mountain; Rajive K. Diwan, Chattanooga, all of Tenn.

[73] Assignee: E. I. du Pont de Nemours and Company, Wilmington, Del.

[21] Appl. No.: 288,523

[22] Filed: Dec. 22, 1988

Related U.S. Application Data

[63] Continuation-in-part of Ser. No. 220,043, Jul. 15, 1988, abandoned.

[51] Int. Cl.[5] ..... D01D 5/12

[52] U.S. Cl. ..... 264/129; 264/130; 264/210.7; 264/210.8; 264/178 F; 264/211.15; 264/290.5

[58] Field of Search ..... 264/210.7, 210.8, 129, 264/130, 290.5, 178 F, 211.15

[56] References Cited

U.S. PATENT DOCUMENTS

| | | | |
|---|---|---|---|
| 3,963,678 | 6/1976 | Conrad et al. | 260/75 |
| 4,009,511 | 3/1977 | Gauntt | 264/210 |
| 4,056,652 | 11/1977 | Gauntt | 428/400 |
| 4,098,864 | 7/1978 | Morris et al. | 264/290 T |
| 4,396,570 | 8/1983 | Pedkinpaugh et al. | 264/210.7 |

*Primary Examiner*—Hubert C. Lorin

[57] ABSTRACT

A process for making oriented thermoplastic monofilaments having a tenacity greater than about 7.5 g/d at a standard deviation in tenacity of less than 0.25.

44 Claims, 9 Drawing Sheets

PROCESS FOR SPINNING AND DRAWING MONOFILAMENTS WITH HIGH TENACITY AND HIGH TENSILE UNIFORMITY

The present application is a continuation-in-part of application Ser. No. 07/220,043 filed July 15, 1988 now abandoned.

BACKGROUND OF INVENTION

This invention relates to heavy denier thermoplastic monofilaments, and more particularly relates to heavy denier thermoplastic monofilaments having high tenacity/high knot strength and high tensile uniformity and a process and apparatus for making such monofilaments.

U.S. Pat. Nos. 4,009,511 and 4,056,652, which are incorporated herein by reference, disclose heavy denier, polyamide monofilaments and a process for their preparation. The process includes the steps of spinning, quenching and drawing a heavy denier, polyamide monofilament in first and second draw stages to a total draw ratio of at least 5.5X. In the first draw stage, the monofilament is exposed to a steam atmosphere where it is drawn at a ratio of at least 3.5X. In the second stage, the monofilament is stretched at a ratio of at least 1.3X in a radiant heating zone. The process disclosed in U.S. Pat. Nos 4,009,511 and 4,056,652 produces a monofilament having a deoriented surface layer having an orientation less than the orientation of the core and has a refractive index, $n_{\parallel}$, of less than 1.567 and the core has a refractive index, $n_{\parallel}$, of greater than 1.57.

While the disclosed process produces monofilaments with high strength and high loop tenacities, the uniformity of tensile properties is not as high as is desired for some end uses. Furthermore, the process of U.S. Pat. Nos. 4,009,511 and 4,056,652 is not easily adapted to produce monofilaments with different deniers at high process speeds.

SUMMARY OF THE INVENTION

In accordance with the present invention, an improved process is provided including the steps of spinning, water quenching, and drawing a heavy denier thermoplastic monofilament in at least first and second draw stages to a total draw ratio of at least 5.5X. The quenched filament is advanced in the first draw stage through a steamer containing a high temperature steam heating zone and is advanced in the second stage through a zone heated with a radiant heater.

In accordance with one improvement in the process of the invention, water is provided on the surface of the monofilament before any contact with guides and surfaces such as feed rolls in the amount of at least 10% by weight based on the dry weight of monofilament. Preferably, the water is provided on the monofilament by regulating residual quench water which is carried by the filament. More preferably, additional water is added to the monofilament after advancing past the feed rolls and before entering the steamer in the amount of above about 5% by weight based on the monofilament dry weight This aspect of the improved process provides significant improvements in tensile uniformity of the monofilament.

In accordance with another improvement of the present invention, the temperature of the quenched filament in advance of the steamer is controlled to correspond with a predetermined first stage draw ratio so that the first stage draw point is maintained at a location after the feed rolls and before the monofilament enters the high temperature steam heating zone of the steamer. Preferably, steamer has a steam expansion zone containing a low temperature steam atmosphere before the high temperature zone and the draw point is maintained in or just ahead of the steam expansion zone. In a preferred form of the present invention, the temperature of the quenched filament is controlled by adjusting the residence time of the monofilament in the quench bath. Alone or preferably when employed together with providing water on the monofilament surface so that water is provided on the surface of the monofilament in the amount of at least about 5% by weight at the draw point, maintaining control of the draw point in accordance with the present invention optimizes tenacity, knot strength and product uniformity and improves process continuity enabling process throughputs in excess of 35 pounds per hour per monofilament.

In accordance with another improvement of the present invention when the steamer has entrance and exit seals for admitting and discharging the monofilament while minimizing steam loss from a high temperature steam heating zone, the monofilament surface prior to passing through the exit seal is cooled. Preferably, the monofilament surface is cooled while passing the monofilament through a water bath before passing through the exit seal. Cooling the surface of the filament before passing through the exit seal minimizes mechanical damage to the monofilament to increase product uniformity.

In accordance with another improvement of the present invention, a process is provided for the second draw stage for subjecting the monofilament to a controlled draw profile while undergoing radiant heating. In accordance with the invention, the monofilament is advanced in the second draw stage to make at least a first pass through a heating zone for radiant heating. The monofilament is contacted with a first change of direction roll before the first pass through the radiant heating zone and is contacted with a second change of direction roll after the first pass, the monofilament contacting the surface of each of the rolls through a wrap angle of between about 75 degrees and about 200 degrees. The speed of the first and second change of direction rolls is controlled so that the tension applied to the monofilament increases as the monofilament advances past each of the rolls.

A preferred form of the process of the invention for the improved second stage draw further includes advancing the monofilament through a second pass through a radiant heating zone after the monofilament advances past the second change of direction roll, the first and second passes being performed successively so that the core temperature of the monofilament increases from the first pass to the second pass. The process also including contacting the monofilament with a third change of direction roll after the second pass, the monofilament contacting the surface of the third roll through a wrap angle of between about 75 degrees and about 200 degrees. The speed of the third change of direction roll is controlled so that the tension on the monofilament increases as the monofilament advances past the third change of direction roll.

Another preferred form of the improved second stage draw further includes advancing the monofilament through a third pass of through a radiant heating zone after the monofilament advances past the third change of direction roll. The second and third passes are performed successively so that the core temperature of the monofilament increases from the second pass to the third pass. The monofilament is further contacted with a fourth change of direction roll after the third pass, the monofilament contacting the surface of the fourth roll through a wrap angle of between about 75 degrees and about 200 degrees. The speed of the fourth change of direction roll may be control past led so that the tension on the monofilament increases as the monofilament advances past the fourth change of direction roll.

In accordance with another aspect of the improved second stage draw, the speed of the first change of direction roll is controlled so that a substantial amount of draw is not imparted to the monofilament until the monofilament advances to the first pass through the radiant heating zone.

The invention further provides apparatus for drawing continuous fiber including a heater for providing at least one heating zone for radiantly heating the continuous fiber and advancing means for advancing the fiber to subject the fiber to at least a first pass through the heating zone. The advancing means includes initial roll means and final roll means and at least first and second change of direction rolls, the final roll means advancing the fiber at a speed greater than the initial roll means to determine a draw ratio for the apparatus. The first and second change of direction rolls determine the path of fiber travel on the first pass through the radiant heating zone and the surface of said first and second change of direction rolls contact the fiber through a wrap angle of between about 75 degrees and about 200 degrees. The speed of said first and second change of direction rolls is controlled, preferably by a hydraulic motor/pump, so that the amount of tension on the fiber increases as the fiber advances past each of the change of direction rolls.

In accordance with the invention, a monofilament of oriented thermoplastic polymer is provided having a denier of greater than about 1000, a tenacity of greater than about 7.5 g/d, a standard deviation in tenacity of less than about 0.25, and a modulus greater than about 45 g/d. Preferably, the thermoplastic polymer is a polyamide and the monofilament has a tenacity of greater than about 8.0 g/d and a standard deviation in tenacity of less than about 0.15.

BRIEF DESCRIPTION OF THE DRAWINGS

The present invention may be understood by reference to the drawings in which:

FIG. 3 is a view as in FIG. 2 showing an alternate monofilament path for one radiant heating pass;

DETAILED DESCRIPTION

Polymers useful for this invention include various thermoplastic polymers and copolymers including polyamides, polyesters, polyolefins, and other such polymers. Typically, high viscosity polymers (for example, intrinsic viscosity greater than 0.7 for polyesters and RV at greater than 50 for polyamides) are used for producing high strength and highly durable industrial filaments in accordance with the present invention. Suitable polyamides include poly-(hexamethylene adipamide) (6-6 nylon), poly-(ε-caproamide) (6 nylon), poly-(tetramethylene adipamide), etc., and their copolymers. Suitable polyesters include poly-(ethylene terephthalate) (2G-T), poly-(propylene terephthalate), poly-(butylene terephthalate), poly-(ethylene 2,6 napthoate), poly-(1,4 cyclohexanedimethanol terephthalate) and their copolymers. Suitable polyolefins include polyethylene, polypropylene, polybutylene, etc., and their copolymers. The process is advantageously employed for the spinning and drawing of polyamides and is ideally suited for the production of 6-6 nylon and 6 nylon monofilaments.

Figure 1:
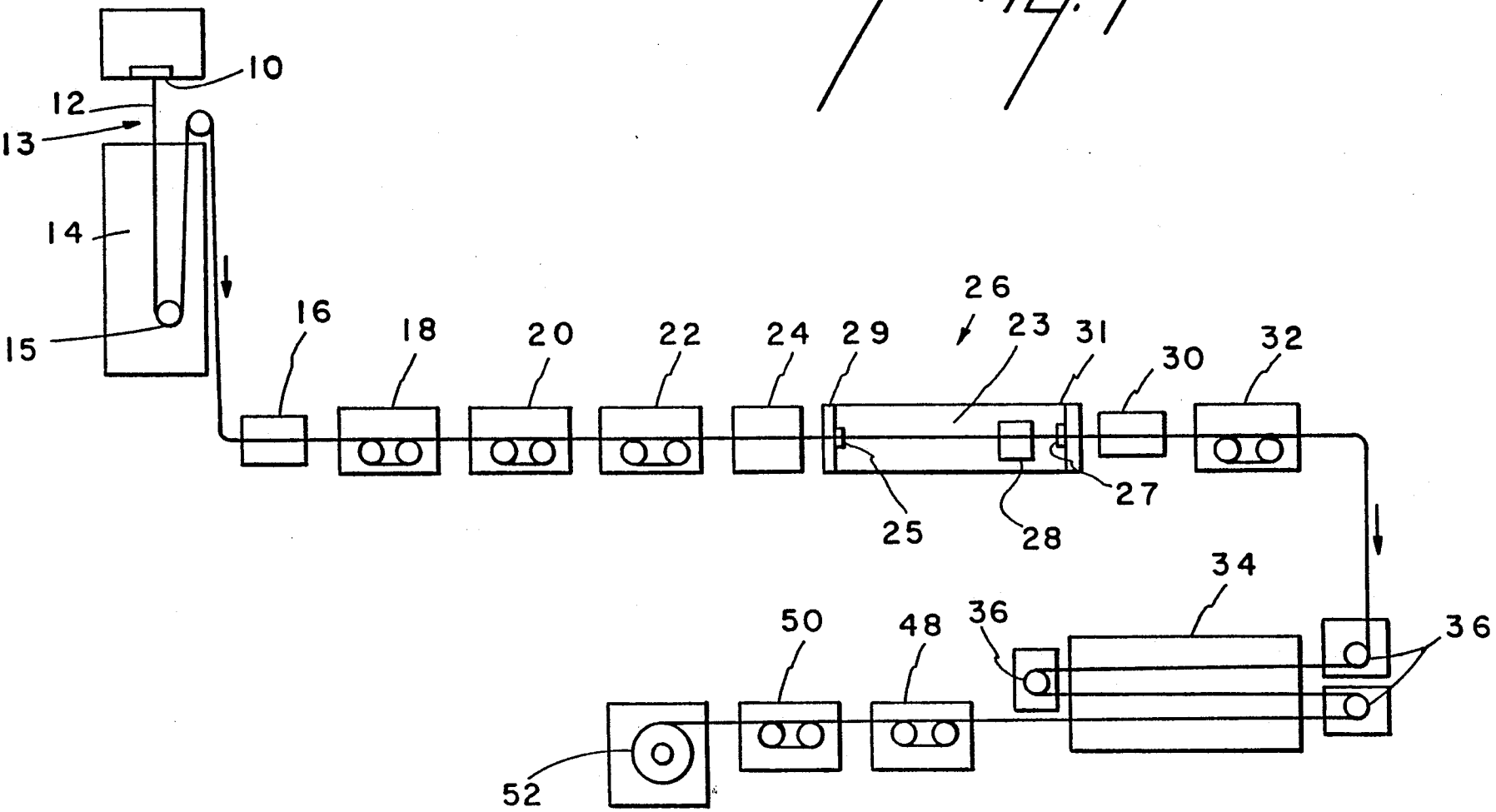
FIG. 1 is a schematic illustration of a process for producing a heavy denier, thermoplastic monofilament in accordance with the present invention.

Referring now to FIG. 1, illustrating a preferred process in accordance with the present invention, the thermoplastic polymer is melt-spun through a spinneret 10 having, for example, a relatively large round, obround or rectangular spinneret orifice. The melt temperature, of course, is appropriate for the polymer being spun. For 6-6 nylon and 2G-T, for example, melt temperatures from 270°-295° C. are suitable. The monofilament indicated by the numeral 12 in FIG. 1 is subjected to attenuation in an air gap 13 below the spinneret and quenched in a quench bath 14 containing water at a temperature less than about 50° C. The air gap 13 should be between about 20 and 40 inches in length before the filament enters the quench bath 14. Tension in the air gap and quench bath is minimized by adjusting the air gap distance in order to minimize the development of positive birefringence and orientation in the monofilament surface before the monofilament is orientation-stretched. However, the tension must be sufficient to provide stability to the threadline in the quench bath.

After leaving the quench bath 14, water in an amount of at least 10% based on the dry weight of the monofilament is provided on the monofilament before it contacts any surfaces such as feed rolls, guides or other surfaces. Preferably, the monofilament encounters an air jet designated by the numeral 16 which regulates residual quench water on the monofilament. Most preferably, the amount of water on the monofilament is between about 10% and about 25% by weight based on the dry weight of the monofilament.

The wet filament is then forwarded to puller rolls 18 which control the tension on the filament when spun and as it advances through the quench bath 14. The monofilament is then advanced through pre-tension rolls 20 and feed rolls 22. The pre-tension rolls are employed to increase tension on the monofilament to stabilize the monofilament on the feed rolls.

The monofilament is drawn in at least two draw stages, the second to be described in detail hereinafter.

In the first draw stage, the monofilament is drawn at a draw ratio of at least 3.0X.

In accordance with the invention, at the draw point of the first draw stage, the monofilament should be wet to obtain a monofilament with optimum tensile properties. Generally, at commercially-desirable spinning speeds, most of the residual quench water left on the monofilament is expelled from the monofilament as it is carried by the puller, pre-tension and feed rolls. Since the location of the first stage draw point is controlled in the preferred form of the invention as will be described hereinafter, water is preferably added before the monofilament enters a steamer 26 at a water addition station 24. Felt wicks are suitably employed to add an amount of water above about 5% by weight based on the monofilament dry weight. Preferably, the amount of added water is between about 5% and about 20% by weight. Further advantage is obtained if the water is applied uniformly such as by metering the water applied or by applying water in excess and then changing the monofilament direction so that excess water is flung off leaving a uniform level on the monofilament.

It is believed that the advantage of having the filament wet at the first stage draw point is due to the imbibition of the water into the surface at the draw point. When the draw point is ahead of the steamer but the monofilament is dry, it is believed the lack of or insufficient water for imbibition leaves a more brittle, lower elongation fiber also with lower tenacity. At the draw point, the amount of water on the monofilament should be uniform and be above about 5%, and preferably between about 5% and about 20%, based on the dry weight of the filament.

During the first stage draw, the monofilament is subjected to a high temperature steam atmosphere in the steamer 26. The first stage draw conditions are selected such that the heat from the steam assists in drawing, which results in orientation of the core and, additionally, the steam substantially deorients and further hydrates the surface of the monofilament to prevent the development of molecular orientation or birefringence in the surface as the filament is stretched. The conditions for the first draw stage are established to conform to the properties of a particular polymer. The steam atmosphere in the steamer 26 for 6-6 nylon is typically between about 80 and 170 psig and the steam may be selected from a range of from 40% wet to 120° F. of superheat.

In the process of the invention, the high temperature steam heating zone during the first stage draw is provided in a pressurized steam chamber 23 of the steamer 26. The pressurized steam chamber 23 is suitably provided by an elongated casing having an entrance seal 25 and an exit seal 27 which minimize steam pressure loss while admitting the monofilament 12 into the chamber 23 and providing an exit for the monofilament at the opposite end. Preferably, the steamer 26 also has separate chambers at each end providing entrance and exit steam expansion zones 29 and 31, respectively, which are connected to a vacuum source (not shown). Seals with openings somewhat larger than the seals 25 and 27 are provided for these chambers for the monofilament to enter and exit the steamer. The primary purpose for the expansion zones is to prevent steam which leaks through the seals 25 and 27 from being vented into the plant environment. However, steam heating of the monofilament in the steamer begins in the lower temperature steam atmosphere in the entrance expansion zone 29.

Since the monofilament surface is heated to above 110° C. in the high temperature steam heating zone and is very deformable as it emerges from the steamer 26, there is a likelihood that the monofilament will become damaged at least intermittently as it exits from the steamer by contact with the exit seal 27. In accordance with the invention, the monofilament surface is cooled prior to passing through the steamer exit seal 27 to less than 110° C. Preferably, this is accomplished as indicated in FIG. 1 by passing the monofilament through a water bath 28 provided within the chamber 23 of the steamer 26. It is advantageous for the bath to have a temperature of less than about 80° C. In the preferred embodiment, the water bath 28 is located in the chamber 23 adjacent the exit seal 27 so that the monofilament is exposed only briefly to high temperature steam in the chamber 23 after the bath and is not substantially reheated. Thus, the the water bath 28 effectively serves as the end of the high temperature steam heating zone.

Figure 8:
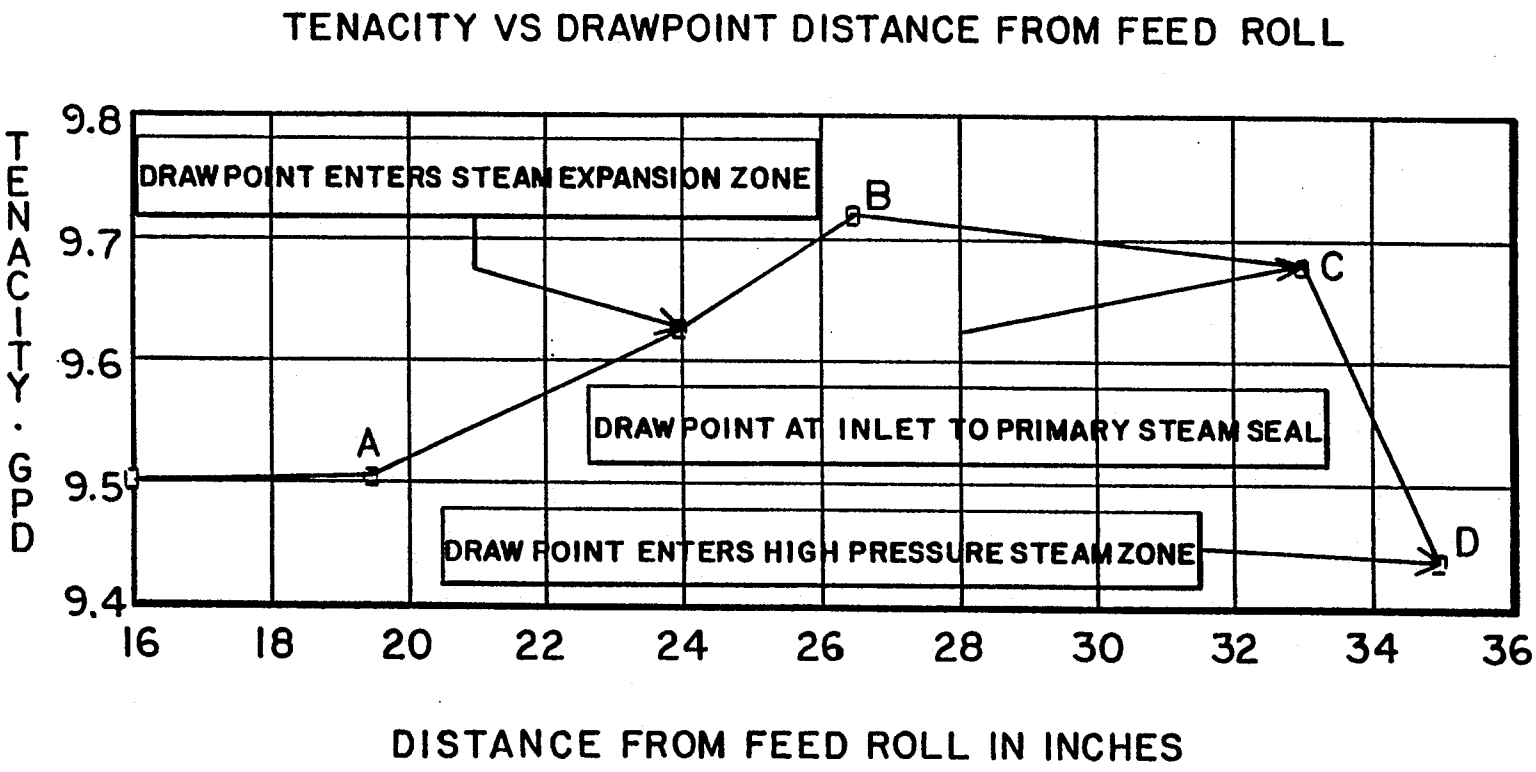
FIG. 8 is a graphical representation of tenacity plotted against draw point distance from the feed roll.
Figure 9A:
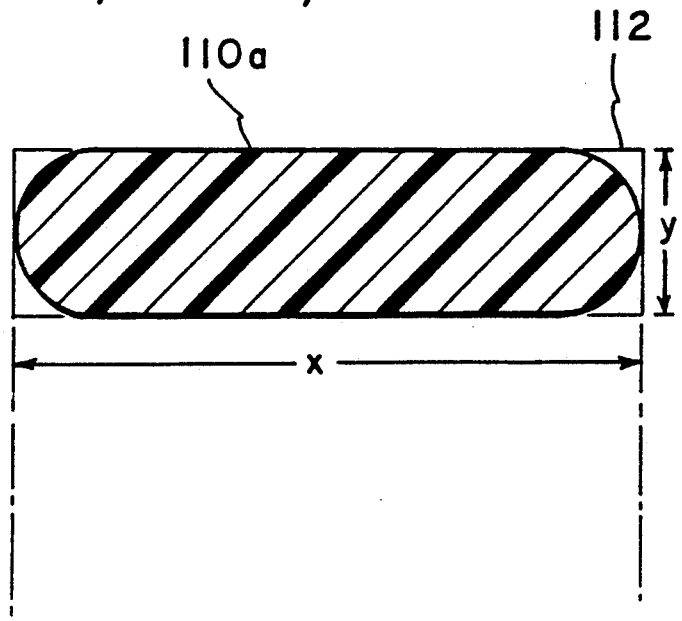
FIGS. 9*a* and 9*b* are cross-sectional views of a preferred monofilaments in accordance with the present invention.
Figure 9B:
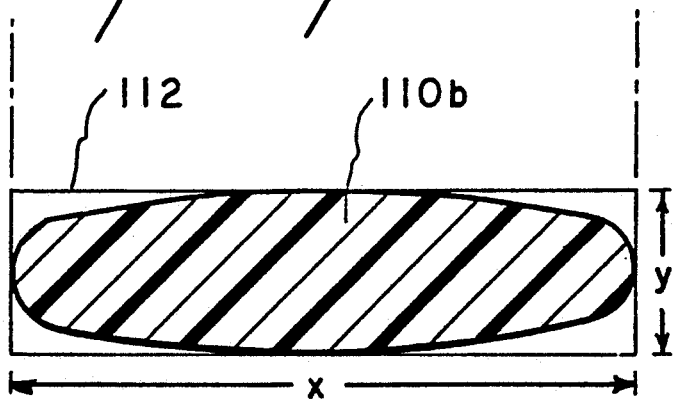

In accordance with the process of the invention, the temperature of the quenched filament in advance of the steamer 26 is controlled to correspond to a predetermined draw ratio so that the first stage draw point is maintained at a location after the feed rolls and before the monofilament leaves the high temperature steam heating zone of the steamer 26 (before entering the bath 28). Preferably, the draw point is maintained after the the feed rolls and before the high temperature zone of the steamer. As illustrated in FIG. 8, the optimum location for the drawpoint is in or just ahead of the entrance steam expansion zone 29 of the steamer 26.

Control of the location of the draw point in accordance with the invention provides substantial improvement in monofilament tenacities. If the filament is too warm and the draw point moves onto the feed rolls 22, tenacity can decrease by as much as 1–2 gpd and the knot strength can decrease up to 2–4 gpd. Similarly, the tensile properties are adversely affected if the draw point moves into the water bath 28 by the monofilament being too cold upon drawing. Although good properties can be obtained with the draw point in the high temperature zone of the steamer, it is believed that through imbibition, too much steam penetrates the surface causing lower tenacity than when the draw point is located before the high temperature zone.

Figure 7:
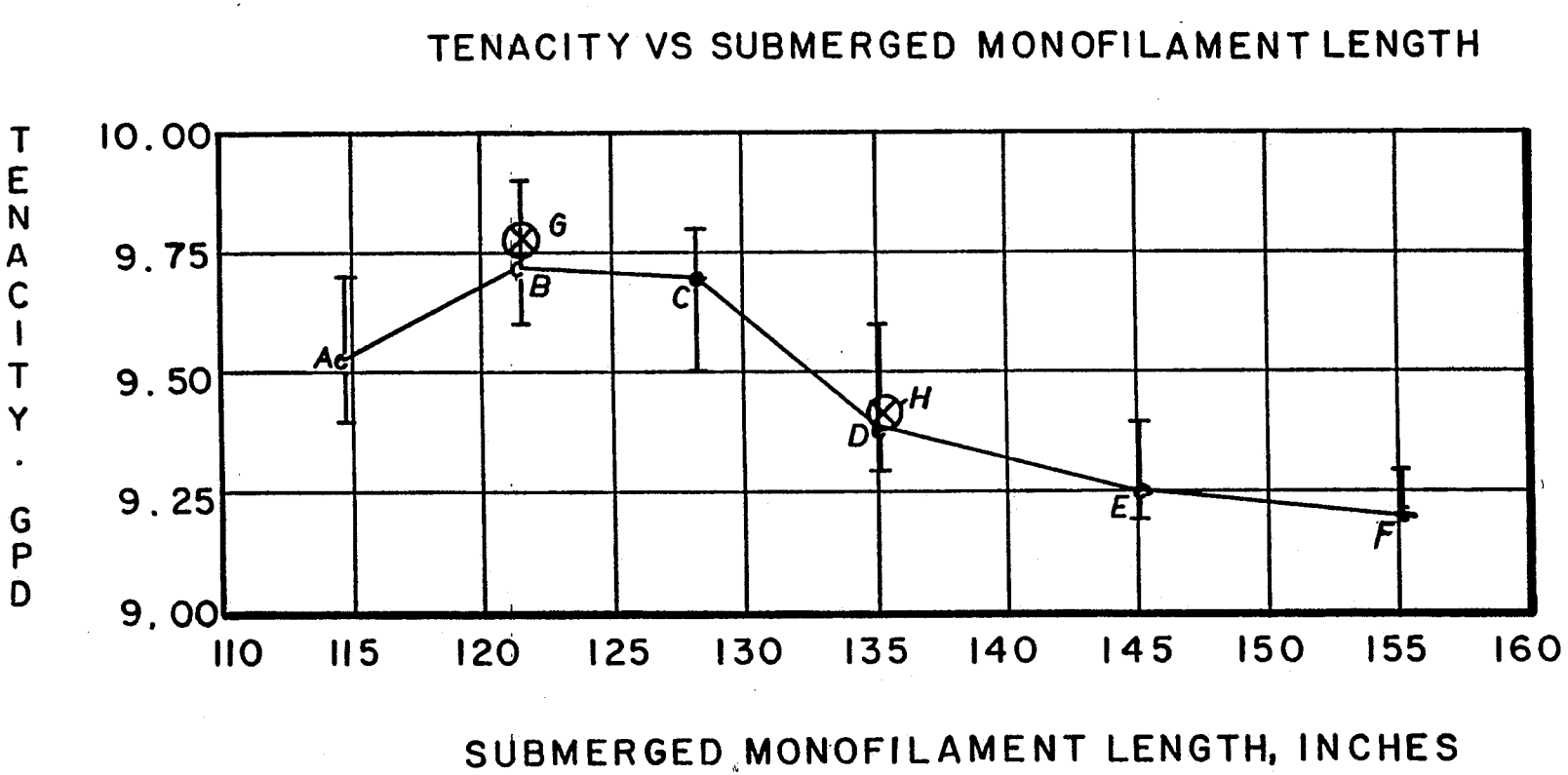
FIG. 7 is a graphical representation of tenacity plotted against the submerged monofilament length in the quench tank.

Preferably, the temperature of the quenched filament is controlled by adjusting the residence time of the monofilament in the quench bath 14 such as by increasing or decreasing the path of travel within the quench bath. As shown in FIG. 1 and with reference to FIG. 7, this is accomplished by providing a change-of-direction point 15 within the quench bath which can be moved, when the process is running, to different depths below the surface of the quench bath 14 to increase or decrease the path of travel in the bath and thus increase or decrease the residence time within the bath. Compensation for variations in the quality of the polymer which would affect the draw point can thereby be provided. In addition, it is also advantageous to select and/or control the temperature of the quench bath to adjust the temperature of the quenched filament. In the most preferred form of the invention, the quench water temperature is controlled to ±0.5° C. and the length of the submerged path of the filament in the quench water is controlled to ±2" (5.1 cm) when the process is operating under steady-state conditions.

The location of the draw point can be monitored visually if it is outside the expansion zone of the steamer. If the draw point is inside the steamer, whether it is in the expansion zone or not can be monitored by measuring the steam flow into the steamer. If the draw point is inside the expansion zone, the steam flow will be greater than when it is inside the high temperature zone because the reduced diameter monofilament will allow more steam to escape at the entrance seal.

After exiting the steamer 26, an air stripper 30 removes most, e.g., leaves less than about 2%, of the surface water on the monofilament.

After exiting from the steamer 26 and passing through stripper 30, the monofilament 12 is then contacted by first stage draw rolls 32. The amount of draw in the first draw stage is determined by the speed of first stage draw rolls in relation to the feed rolls 22. The first stage draw rolls 32 are preferably heated to begin heating the monofilament for the second stage draw. Heated draw rolls enable the use of a shorter path length through the second stage heater and better control the second stage draw. For 6-6 nylon, the rolls are heated to a temperature of 110°-160° C., preferably about 140° C.

From the first stage draw rolls 32, the monofilament 12 advances into a radiant heater 34 employed in the second stage draw. Radiant heating in the second stage draw involves the use of a heater 34 at temperatures and residence times matched to the polymer of the monofilament. For 6-6 nylon, a temperature of 700° C. to 1300° C. with an exposure time such that the filament surface temperature remains at least 10° C. below the melting point of the polymer is preferably employed.

In the present process, the second stage draw is performed such that the draw of the monofilament progresses as the core temperature of the filament increases. Referring again to FIG. 1 and also to FIGS. 2-5 which illustrate preferred apparatus for use in the second stage draw, at least one pass through a heating zone in the heater is performed by conveying the filament through the radiant heater by means of controlled speed change-of-direction rolls designated generally in FIG. 1 by the numeral 36 which contact the monofilament before and after one or more passes through the heater 34.

Figure 2:
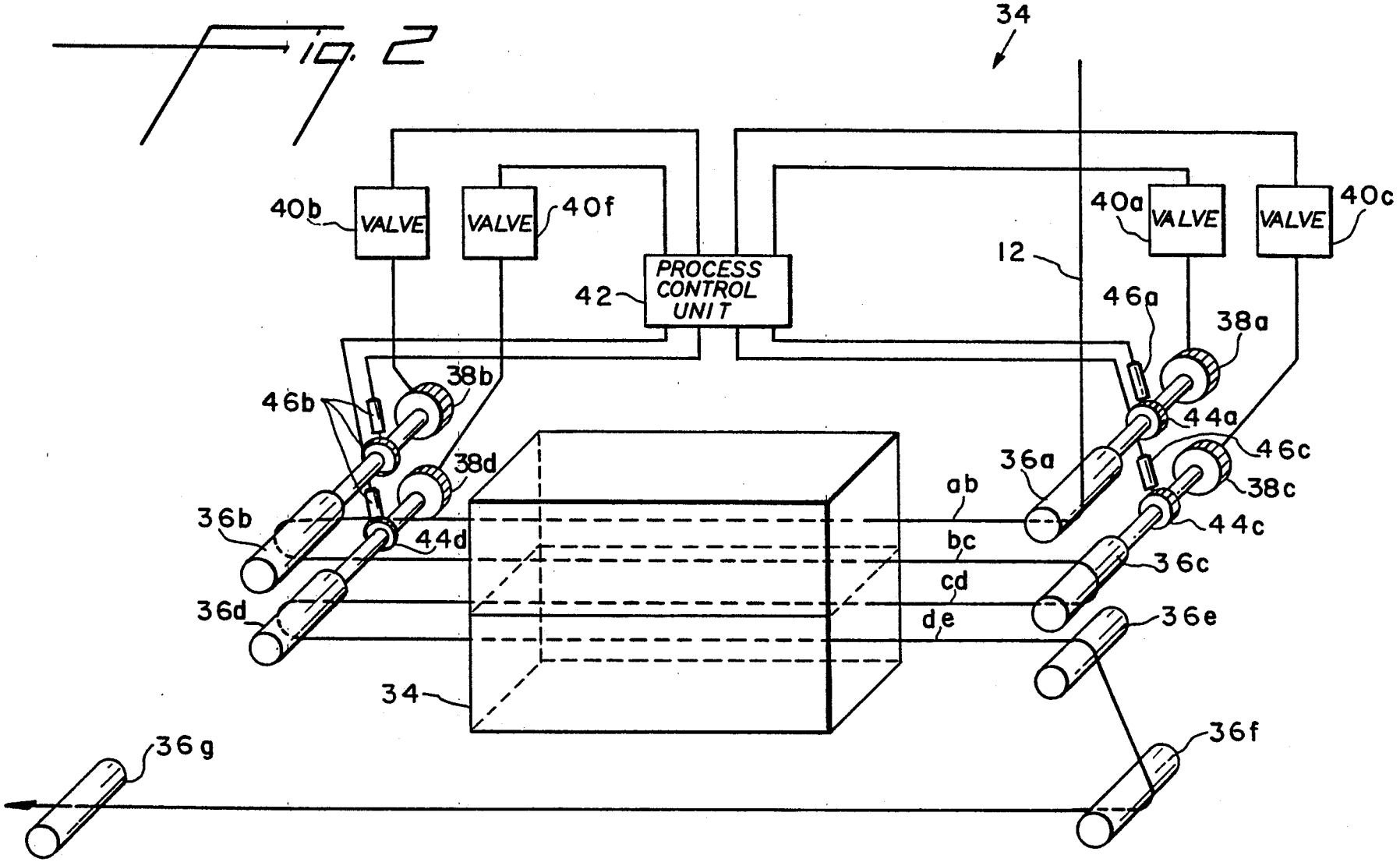
FIG. 2 is a partially schematic view of preferred apparatus for a second stage draw in accordance with the present invention with the monofilament making four passes for radiant heating.
Figure 10:
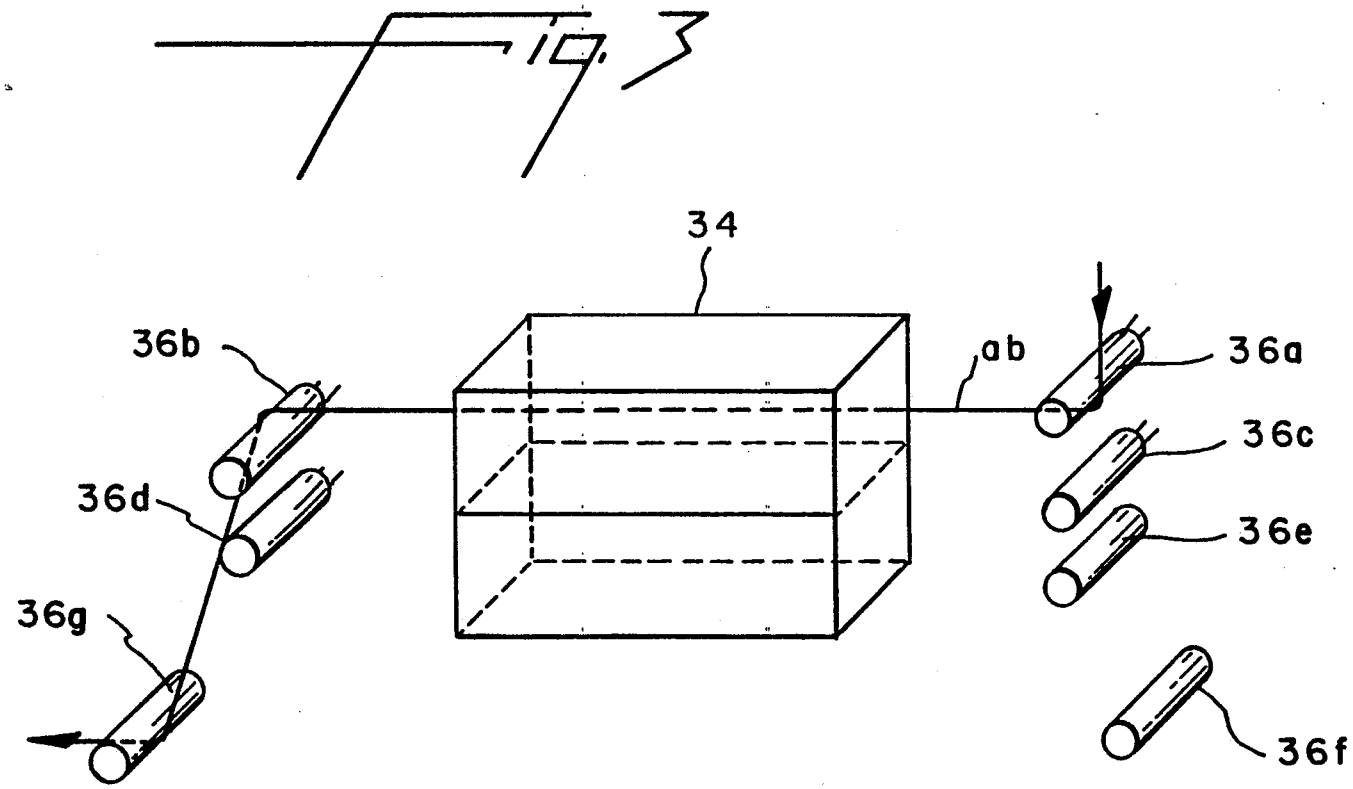

Referring now with more particularity to FIG. 2 which illustrates the invention with four passes through the heater 34, the preferred apparatus includes change-of-direction rolls designated by the numerals 36*a* through 36*g*. The axes of all of the change-of-direction rolls are essentially parallel with each other and all are journalled for rotation.

The speed of the change-of-direction rolls 36*a* through 36*d* are controlled so that the tension on the monofilament increases as the monofilament advances past each of these change-of-direction rolls. In the preferred embodiment depioted, the rolls 36*a* through 36*d* are connected to hydraulic motors/pumps 38*a* through 38*d*, respectively, which act as brakes for the roll thereby increasing the tension on the monofilament as the monofilament advances past each roll. This is suitably accomplished by the hydraulic motors being connected to valves 40*a* through 40*d* which are connected and controlled by a process control unit designated by the numeral 42. A tachometer is provided for each of the rolls 36*a* through 36*d* such as by toothed gears 44*a* through 44*d* and adjacent pickups 46*a* through 46*d*. The process control unit 42, which can be an analog or digital controller, receives tachometer signals from the pickups 46*a* through 46*d* and is capable of actuating the valves connected to the hydraulic motors/pumps 38*a* through 38*d* to individually control the speed of the change-of-direction rolls 36*a* through 36*d* in a predetermined manner. Roll 36*e* can be a controlled speed roll if desired. It will be understood that devices other than hydraulic motors/pumps can be employed to effect the control over the speed of the change-of-direction rolls such as synchronous electric motors and friction brakes and that additional controlled speed rolls can be used to provide additional passes through the heater.

In the apparatus as depicted in FIG. 2, the monofilament 12 makes a total of four passes through the heater 34 identified by the characters ab, bc, cd, and de and contacts the surfaces of the rolls 36*a*-36*d* through a wrap angle of at least about 75° and up to about 200° so that the speed of the monofilament in contact with the rolls is controlled by the speed of the rolls without contacting the rolls for a length of time which substantially cools the core of the monofilament. The change-of-direction rolls are located proximate to the heater so that the time outside the heater is limited so that the filament core temperature increases on each successive pass through the heater.

Referring again to FIG. 1, the overall draw in the second stage draw is determined by the speed of a pair of second stage draw rolls 48 in relation to the first stage draw rolls 32. However, as illustrated in FIG. 2, the amount of draw in each of the passes through the heater 34 within the second stage draw is determined by the speed of the rolls defining that particular pass as controlled by the process control unit 42. For example, the draw in the pass ab is determined by the ratio between the change-of-direction roll 36*a* and the change-of-direction 36*b*. Pass bc is determined by rolls 36*b* and 36*c*, pass cd by rolls 36*c* and 36*d* and pass de by roll 36*d* and the second stage draw rolls 48. Preferably, roll 36*a* has a speed in relation to the first stage draw rolls 32 so that the monofilament is not subjected to a substantial amount of draw before entering the heater 34 to insure that the draw point is maintained within the heater.

Figure 4:
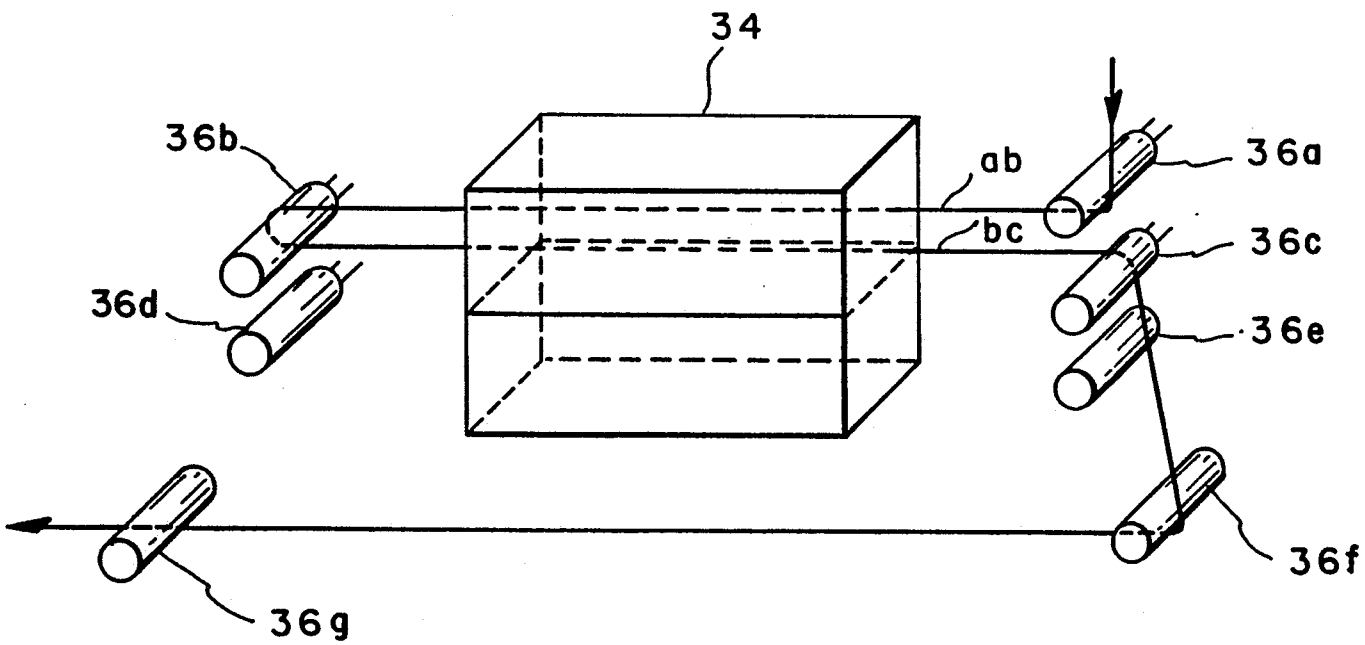
FIG. 4 is a view as in FIG. 2 showing an alternate monofilament path for two radiant heating passes.
Figure 5:
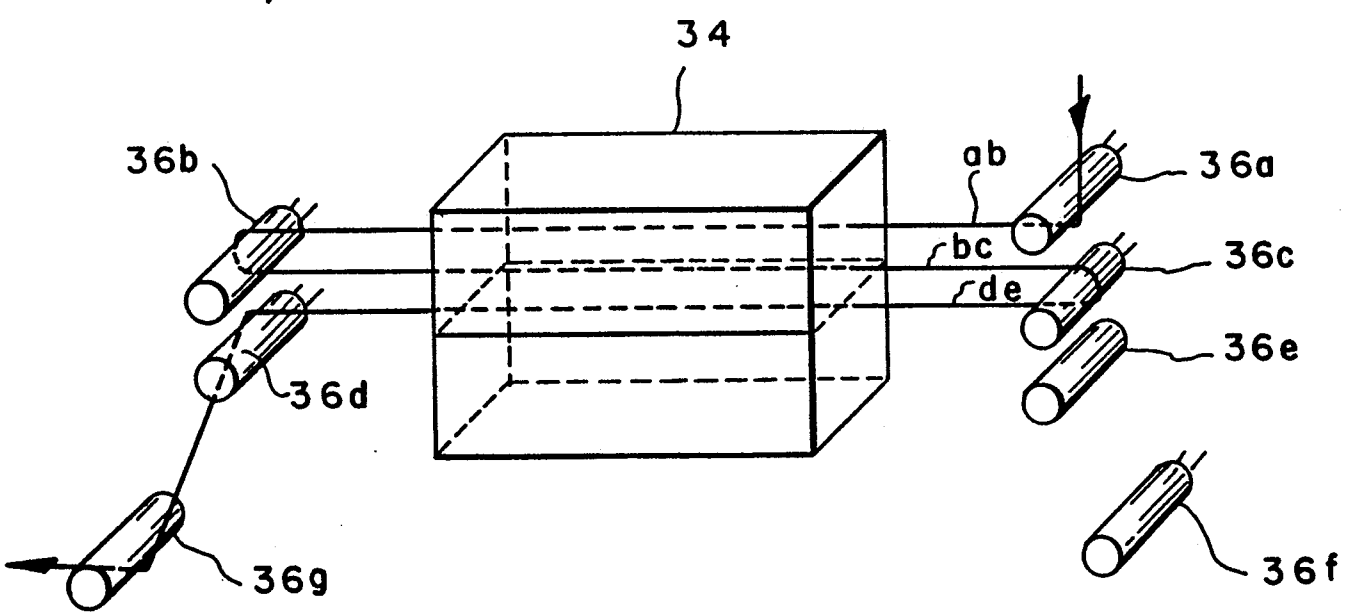
FIG. 5 is a view as in FIG. 2 showing an alternate monofilament path for three radiant heating passes.

Referring now to FIGS. 3, 4 and 5, it is illustrated that the present invention can be used to provide a process in which the monofilament is subjected to one, two, three, or the four passes illustrated in FIG. 2 necessary to achieve a desired draw profile for the type of monofilament being produced. FIG. 3 illustrates one pass ab through the heater by employing rolls 36*a* and 36*b* which is useful for fiber such as lower denier monofilament which is adequately heated without multiple passes. FIG. 4 illustrates two passes, ab and bc, by omitting rolls 36*d* and 36*e* and employing idler roll 36*f* as in FIG. 2. FIG. 5 illustrates three passes, ab, bc, and cd, by omitting roll 36*e* and idler roll 36*f* with the path running from roll 36*d* directly to idler roll 36*g*.

The apparatus for the second stage draw illustrated in FIG. 2 enables controlled second stage temperature and draw profiles. For 6-6 nylon, for example, an optimum second stage draw profile is one that does not exceed a total draw ratio of about 4.0 until the filament core temperature is greater than that at which a molecular crystal transformation takes place such as the triclinic to hexagonal transformation that is believed to take place at 140°-160° C. If draw in excess of 4.0X occurs below this temperature, molecular chains will rupture because the intramolecular bonds of the triclinic crystal are greater than the carbon-carbon chain bonds which reduces molecular weight and, in turn, tenacity and fiber fatigue resistance. The apparatus of FIG. 2 also enables a higher surface temperature than the core at the correct point in the draw profile. The surface temperature in the second stage draw should cause the monofilament surface to lose most of its orientation and just attenuate during the second stage draw. This is desirable to achieve a substantially unoriented skin on the monofilament which gives good knot strength, adhesion to rubber and flex fatigue resistance. The temperature at which this attenuation versus drawing occurs is determined by the amount of hydration of the surface polymer that occurs in the first stage steamer. For example, for 6-6 nylon in this process, a surface temperature of 220° C. is adequate to cause the desired low surface orientation.

Figure 6:
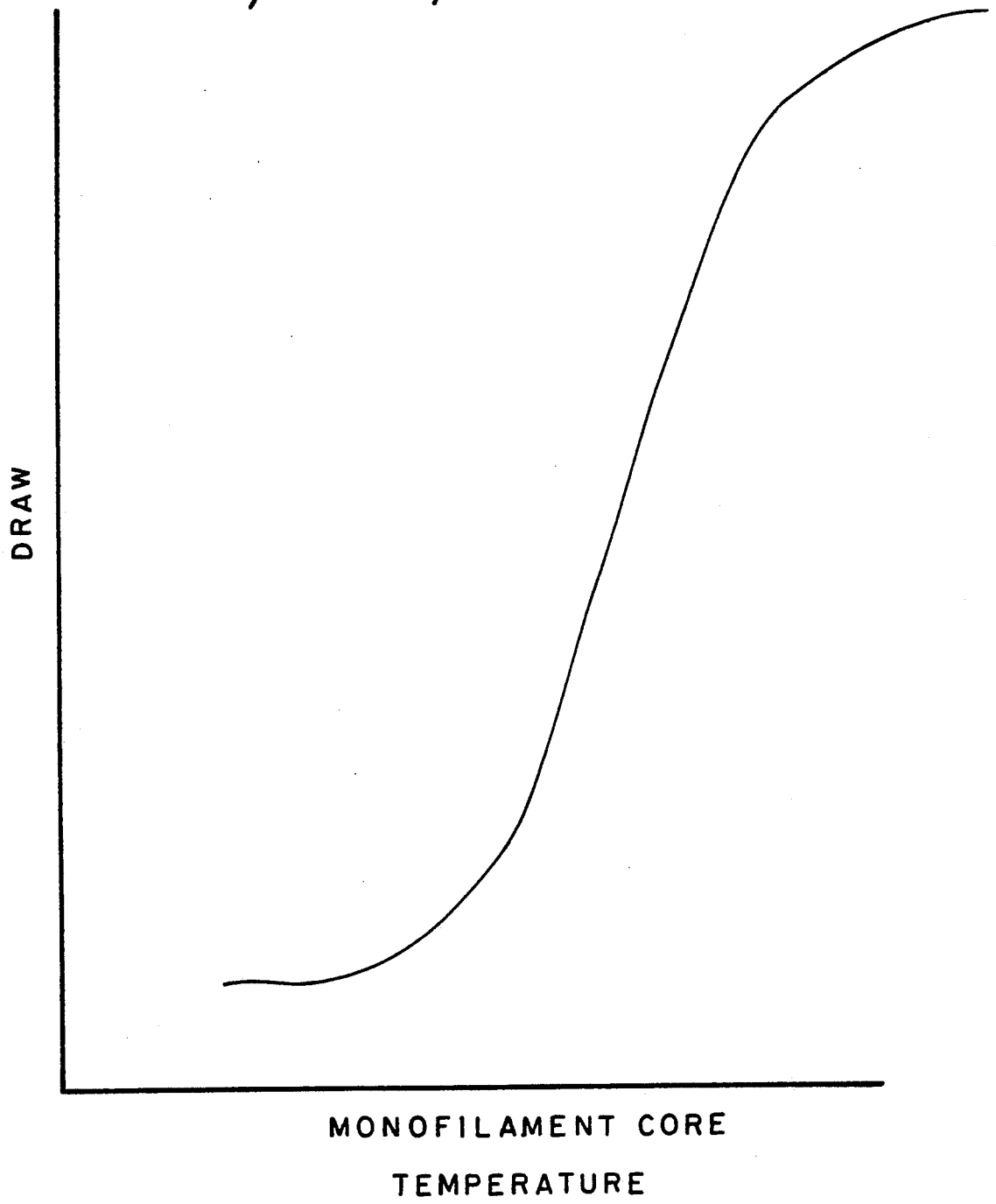
FIG. 6 is a graphical representation of draw versus monofilament core temperature for an ideal second stage draw profile.

FIG. 6 illustrates an ideal second stage draw profile (draw versus filament temperature) which generally produces desirable monofilament properties and minimizes monofilament breaks in the process. The process and apparatus of the invention can be used to approximate the ideal draw with less draw at the beginning and end of the temperature increase and more draw at an intermediate temperature. Due to the ability to provide more accurate control of the second stage draw, multiple passes through the radiant heating zone are preferred in a process in accordance with the present invention. Most preferably, at least three passes are employed.

The preferred second stage draw apparatus in accordance with the invention provides the versatility to produce a wide variety of differing monofilament deniers at different process speeds with the same process equipment while providing an optimum draw profile for the product. The process and apparatus avoids the use of separate draw stages which are accompanied by substantial monofilament cooling between stages and increased opportunity for monofilament damage.

Referring again to FIG. 1, the monofilament exiting from the second stage draw rolls 48 passes around tension let-down rolls 50 before windup of the monofilament on a package 52.

The process in accordance with the invention produces monofilaments superior in tensile properties and tensile uniformity to monofilaments disclosed in U.S. Pat. Nos. 4,009,511 and 4,056,652 and can produce such monofilaments at high throughput and/or higher spinning speeds. In a preferred form of the present invention, monofilaments are spun at a polymer throughput rate of greater than about 16 kg (35 pounds) per hour per monofilament.

By employing the process of the invention, monofilaments of the invention can be produced which have a tenacity of greater than about 7.5 g/d at high tensile uniformity, i.e., standard deviation of less than 0.25. Preferably, in polyamide monofilaments, the tenacity is greater than about 8.0 g/d at a standard deviation of less than 0.15. The modulus of the monofilaments is above about 45 g/d and preferably is above about 50 g/d when the monofilament is produced from a polyamide. The toughness of the monofilaments is greater than about 0.5 g-cm/denier-cm. Knot strength for the monofilaments is above about 5.0 g/d at a standard deviation of less than 0.6. In addition, these properties can be achieved when the process of the invention is used to produce 1,000–12,000 denier monofilaments at a throughput rate of greater than 35 pounds per hour per threadline and/or at process speeds of 1200 ypm or more.

Monofilaments in accordance with the invention have a variety of cross-sectional shapes. Referring to FIGS. *9a–9b* depicting preferred monofilaments **110*a*–110*b* in accordance with the invention, the monofilaments have an oblong cross-section with a width-to-thickness ratio greater than about 2.0 and a width in mm greater than about $1.22/(\text{density})^{\frac{1}{2}}$. By "oblong", it is intended to refer to any of a variety of elongated cross-sectional shapes which are circumscribed by a rectangle 112 as shown in FIGS. *9a–9b*** with its width (major dimension) designated in the drawing by "x" greater than its thickness (minor dimension) designated by "y".

Preferably, in a monofilament in accordance with the invention, the cross-section is obround as shown in FIG. *9a*, i.e., having a generally rectangular cross-section with rounded corners or semicircular ends and thus is produced by spinning through an obround or rectangular spinneret. Depending on the viscosity of polymer as extruded, the resulting monofilament has a cross-section which may vary somewhat from the cross-section of the spinneret and may assume some oval character and the "flat" areas may be somewhat convex. As used herein for cross-sections of monofilaments, obround is intended to refer to obround cross-sections or those which approximate obround cross-sections. Other preferred embodiments include monofilaments with an oval cross-section as shown in FIG. *9b*.

In the preferred monofilaments having an oblong cross-section, the width-to-thickness ratio of the monofilaments, i.e., the width x of the circumscribing rectangle divided by the thickness y, is greater than about 2.0. While the advantages of the invention are realized increasingly with increasing width-to-thickness ratio above about 2.0, a practical upper limit for the monofilaments is ultimately reached for in-rubber applications when the spacing needed between adjacent cords becomes so large at a rivet area of, for example 35%, that there is insufficient support for the rubber between cords and rubber failure occurs. Also, as the width-to-thickness ratio becomes very large (film-like filament) high shear and bending stresses will ultimately cause filament buckling and splitting. Thus, it is generally preferable for the width-to-thickness ratio of monofilaments of the invention not to exceed about 20.

The preferred monofilaments of the invention have a width in mm greater than about $1.22/(\text{density})^{\frac{1}{2}}$ with density being expressed here and throughout the present application as g/cc. For poly(hexamethylene adipamide) and poly(ε-caproamide) polyamides, the densities are in the range of 1.13–1.14. For poly(ethylene terephthalate) polyester the density is 1.38–1.41. Thus, the width of polyamide and polyester monofilaments is greater than about 1.15 mm and 1.03 mm, respectively. Monofilaments of the invention with greater than these widths can be manufactured at high productivity and also reduce the end count in fabrics thereby lowering cost in use. High manufacturing productivity results from increasing product denier via making wider filaments without increasing thickness. Surprisingly, the speed at which preferred monofilaments of this invention can be spun, quenched and drawn is dependent only on their thickness. Hence, wider filaments produce more pounds/hour/threadline than narrow filaments of the same thickness. It has been discovered that monofilaments which best combine the advantages of high productivity and high value to the customers in rubberized fabrics have widths in mm greater than $1.22/(\text{density})^{\frac{1}{2}}$.

The denier of the monofilaments in accordance with the invention is above about 1,000 and can be as great as about 12,000 or more. Monofilaments having a denier of greater than about 2,000 are preferred.

Monofilaments produced in the process have a deoriented surface layer which for polyamides is about 3-15 microns thick with a parallel refractive index, n ||, of less than 1.567 and a core parallel refractive index, n ||, of greater than 1.57. Due to the deoriented surface layer which provides good adhesion to rubber, the monofilaments are ideally suited for in-rubber applications.

The invention is further illustrated in the examples which follow in which the results reported are determined by the following test methods.

TEST METHODS

Conditioning: Large denier monofilaments of this invention require up to 10 days for the moisture content to fully equilibrate with atmospheric moisture. In the testing of filaments described in the following, various periods of time less than that required to achieve full moisture regain were sometimes used. For example, a 2000 denier monofilament that is about 0.012" thick takes about three days to equilibrate, but a 6000 denier filament that is about 0.018" thick takes about five days. The actual length of time required depends on the thickness of the monofilament. The monofilament properties reported in the Examples were measured after 24 hours of conditioning after spinning. For properties set forth in the claims, measurement is intended at full moisture equilibration (when two measurements of denier 24 hours apart are the same).

Relative Viscosity: Relative viscosity of polyamides refers to the ratio of solution and solvent viscosities measured in capillary viscometer at 25° C. The solvent is formic acid containing 10% by weight of water. The solution is 8.4% by weight polyamide polymer dissolved in the solvent.

Width and Thickness: Width and thickness are measured with a Starrett Model 722 digital caliper or equivalent instrument. For width measurements it is convenient to fold the monofilament into a "V" and measure both sides of the "V" at the same time, being sure to keep the vertex of the "V" just outside the measured zone. This technique assures that the monofilament does not tilt between the faces of the measuring instrument giving a low reading.

Denier: The monofilament is conditioned at 55±2% relative humidity, and 75°±2° F. on the package for a specified period, usually 24 hours when the monofilament has aged more than ten days since being made. A nine meter sample of the monofilament is weighed. Denier is calculated as the weight of a 9000 meter sample in grams.

Tensile Properties: Before tensile testing of as-spun monofilaments, the monofilament is conditioned on the package for a minimum specified period at 55±2% relative humidity and 75°±2° F. This period is usually 24 hours when the filament has aged more than ten days since spinning. A recording Instron unit is used to characterize the stress/strain behavior of the conditioned monofilament. Samples are gripped in air-activated Type 4-D Instron clamps maintained at at least 40 psi pressure. Samples are elongated to break while continuously recording monofilament stress as a function of strain. Initial gauge length is 10 inches, and cross head speed is maintained at a constant 6 inches/minute.

Break Strength is the maximum load achieved prior to rupture of the sample and is expressed in pounds or kilograms.

Tenacity is calculated from the break strength divided by the denier (after correcting for any adhesive on the filament) and is expressed as grams per denier (g/d).

Elongation is the strain in the sample when it ruptures.

Modulus is the slope of the tangent line to the initial straight line portion of the stress strain curve, multiplied by 100 and divided by the dip-free denier. The modulus is generally recorded at less than 2% strain The knot tensiles are measured in the same manner as straight tensiles except that a simple overhand knot is tied in the monofilament at about the midpoint of the sample to be tested. The simple overhand knot is made by crossing a length of monofilament on itself at about the midpoint of its length and pulling one end through the loop so formed. Since the monofilament tends to assume some of the curvature of the wind-up package, the knot is tied with and against this curvature on separate samples and the two values averaged.

Toughness is measured by dividing the area underneath the stress-strain curve by the product of the Instron gauge length and the corrected denier.

EXAMPLE 1

This example describes the preparation of an approximately 3,000 denier polyhexamethylene adipamide monofilament by a preferred process in accordance with the invention.

High quality polyhexamethylene adipamide polymer is made in a continuous polymerizer having a relative viscosity of 70 and is extruded into a monofilament at the rate of 48 pounds per hour (21.8 kg/hour) through an obround spinneret orifice (rectangular having rounded corners 2.79×9.65 mm), is passed vertically downward through an air gap of 26½ inches (67.3 cm), and is quenched in water at 22° C. for a distance of about 137 inches (348 cm). After water quenching, the amount of residual quench water on the filament is regulated by adjustment of the air flow in an air jet so that quantity of water on the surface of the filament is between 10 and 25% by weight water on the dry weight of the monofilament. The wet monofilament is then forwarded in sequence to a puller roll at 214.6 ypm (196.2 mpm), pretension rolls at 214.8 ypm (196.4 mpm), and feed rolls at 218 ypm (199.3 mpm). After the feed rolls, water is added to the monofilament by contacting the filaments with felt wicks supplied at the rate of 0.8 gallon per hour (13% water added based on dry weight of the monofilament) and the monofilament is forwarded into a 49 cm. long steamer and treated with saturated steam at 137 psig (178° C.). The monofilament contacts a change of direction roll before entering the steamer which reduces the water on the monofilament to relatively uniform level of about 15%. The steamer has entrance and exit steam expansion chambers connected to a vacuum source to prevent steam from leaking into the plant environment.

While still in the steamer but near the exit end of the high pressure steam chamber, the monofilament is run through a bath about 3 cm long containing water at a temperature of about 60° C. and flowing at the rate of about four gallons per hour. The surface of the monofilament is cooled in the bath before leaving the steamer in order to avoid damage of the filament by the exit seal of the steamer. The monofilament is then forwarded to an air stripper which removes most of the surface water from the filament to a level of <2% water on weight of the dry filament. The monofilament is then forwarded to the first stage draw rolls which are heated to 142° C. and running at 814 ypm (744 mpm). Under these conditions, the draw point is within the entrance expansion zone just before the inlet seal af the steamer.

The filament is then forwarded in three passes through a radiant heater of about 50 inches (127 cm) in length at a mean temperature of about 870° C. using apparatus as depicted in FIG. 2 with the monofilament path as in FIG. 5. The amount of draw is controlled in each pass, commensurate with the increasing temperature of the filament, by carefully controlling the speed of the change-of-direction rolls positioned between each pass through the heater. The change-of-direction rolls are drag rolls where the speed is controlled by restricting the discharge flow of a hydraulic pump attached to the roll shafts. Thus, the roll speed before pass 1 is 844 ypm (772 mpm) (tension on the monofilament before pass 1 is 4000 g), before pass 2 is 1038 ypm (949 mpm), before pass 3 is 1110 ypm (1015 mpm), and after pass 3 is 1225 ypm (1120 mpm) (tension approximately 10,400g). The monofilament is then forwarded to second-stage draw rolls running at about 1250 ypm (1143 mpm), let down rolls at about 1227 ypm (1122 mpm) and to a wind-up package. The tension at wind-up is about 500 grams and is adjusted to give good package formation.

The product of the process is an obround cross-section monofilament of 3000 denier and the conditioned properties are shown in Table 1.

EXAMPLE 2

This Example describes the preparation of an approximately 4,000 denier polyhexamethylene adipamide monofilament by a process in accordance with the invention. This example illustrates the improved tensile properties obtained through applying additional water to the monofilament after the feed roll (Cf. Part I), improved properties resulting from providing water on the monofilament before contacting guides and surfaces (Cf. Part II), and improved properties resulting from cooling the monofilament before exiting the steamer (Cf. Part III). Part IV illustrates controlling the draw point in the first draw stage at different locations. Part V illustrates changing the draw profile in the second stage draw.

High quality polyhexamethylene adipamide polymer is made in a continuous polymerizer having a relative viscosity of 70 and is extruded into a filament at the rate of 38.8 pounds per hour 17.6 kg/hour) through an obround spinneret orifice (rectangular having rounded corners 2.79×9.65 mm), is passed vertically downward through an air gap of 28¼ inches (71.8 cm), and is quenched in water at 22° C. for a distance of about 123.5 inches (313.7 cm). After water quenching, the amount of residual quench water on the filament is regulated by adjustment of the air flow in an air jet so that quantity of water on the surface of the filament is between 10 and 25% by weight water on the dry weight of the monofilament. The wet monofilament is then forwarded in sequence to a puller roll at 130.6 ypm (119.4 mpm), pretension rolls at 131.5 ypm (120.25 mpm), and feed rolls at 133.1 ypm (122.7 mpm). After the feed rolls, water is added to the monofilament by contacting the filaments with felt wicks supplied at the rate of 0.6 gallon per hour (12.9% water added based on dry weight of the monofilament) and the filament is forwarded into a 49 cm. long steamer and treated with saturated steam at 140 psig (180° C.). The monofilament contacts a change of direction roll before entering the steamer which reduces the water on the monofilament to a relatively uniform level of about 15%. The steamer has entrance and exit steam expansion chambers connected to a vacuum source to prevent steam from leaking into the plant environment.

While still in the steamer but near the exit end, the monofilament is run through a bath about 3 cm long containing water at a temperature of about 60° C. and flowing at the rate of about 4 gallons per hour. The surface of the monofilament is cooled in the bath before leaving the steamer in order to avoid damage of the filament by the exit seal of the steamer and by monomer deposits on the exit seal. The monofilament is then forwarded to an air stripper which removes most of the surface water from the filament to a level <2% water on weight of the dry filament. The monofilament is then forwarded to the first stage draw rolls which are heated to 142° C. and running at 496.4 ypm (453.9 mpm). Under these conditions, the draw point is within the entrance steam expansion zone of the steamer.

The filament is then forwarded in three passes through a radiant heater of about 50 inches (127 cm) in length at a mean temperature of about 870° C. using apparatus as depicted in FIG. 2 with the monofilament path as FIG. 5. The amount of draw is controlled in each pass, commensurate with the increasing temperature of the filament, by carefully controlling the speed of the change-of-direction rolls positioned between each pass through the heater. The change-of-direction rolls are drag rolls where the speed is controlled by restricting the discharge flow of a hydraulic pump attached to the roll shafts. Thus, the roll speed before pass 1 is 515 ypm (471.2 mpm) (tension on the monofilament before pass 1 is 5300 g), before pass 2 is 592 ypm (541.5 mpm), before pass 3 is 679.5 ypm (621.3 mpm), and after pass 3 is 738 ypm (674.8 mpm) (tension approximately 13,800 g). The monofilament is then forwarded to second-stage draw rolls running at about 750 ypm (685.8 mpm), let down rolls at about 736 ypm (673 mpm) and to a wind-up package. The tension at wind-up is about 750 grams and is adjusted to give good package formation.

The product of the process is an obround cross-section monofilament of 4000 denier and the conditioned properties shown in Table 1.

EX.2 PART I

A 4000 denier poly(hexamethylene adipamide) monofilament was prepared as in Example 2, except that no additional water was applied after the feed roll. Water on the filament after quench was about 20 weight % based on the dry weight of the filament. The monofilament properties are listed in Table 1 and show a greater standard deviation in tenacity than in example 2.

EX.2 PART II

A 4000 denier poly(hexamethylene adipamide) monofilament prepared by the process used for Example 2, except that no water was left on the filament after leaving the water quench tank and none was applied after the feed roll. An air jet stripper and felt were used to remove essentially all water after quenching. Yarn contact guides were not all mirror surfaces. Properties are listed in Table 1. It can be seen that the straight and knot tensiles were inferior to those of example 2. Moreover, the standard deviation (sigma) in the tensile values was very high relative to example 2.

EX.2 PART III

A monofilament was prepared as in example 2 except that the monofilament was not cooled with water before exiting the high temperature, high pressure zone of the steamer. Monofilament properties are listed in Table 1. The straight tenacity and especially the knot tenacity were adversely affected by the lack of cooling of the filament before exiting the steamer. Moreover, material is deposited on the exit seal if water cooling is not used. These deposits cause mechanical damage and low tensile properties.

EX.2 PART IV

Monofilaments identified as A–H show the effect of control of the draw point of the first stage draw by controlling the residence time by adjusting the length of monofilament submerged in the quench bath. The process described in example 2 was employed except that the submerged filament length in the quench bath was varied from 115 to 155 inches. The resulting filament tenacities are plotted in FIG. 7 as a function of submerged monofilament length. FIG. 8 is a plot of tenacity versus the distance of the draw point from the feed roll.

In addition, monofilaments identified as G and H were also made for an extended period as in Example 2 except with submerged monofilament lengths of 121 and 135 inches, respectively. Tensile properties of production lots of these monofilaments are given in Table 2.

The tenacity of monofilaments A–H range from about 9.2–9.8 g/d at submerged filament quench lengths of 115–155 inches. However, there is an optimum quench length of about 121–128 inches where the filament tenacity is at a maximum of about 9.7–9.8 g/d at which the draw point is located prior to the high pressure, high temperature steam heating zone of the steamer (in or just before the entrance steam expansion zone of the steamer).

EX.2 Part V

A monofilament was prepared as in example 2 except that the speeds of the change-of-direction rolls in the radiant heater of the second stage draw were changed as described in Table 3 to produce the following two conditions: (A) cause draw to occur earlier in the radiant heater, and (B) to cause draw to occur later in the radiant heater. Both cases gave results, shown in Table 3, inferior to Example 2 illustrating that the speed of the change of direction rolls in the radiant heater is controlled so that the increment of draw in each pass corresponds to the increase in temperature of the filament in that pass to achieve maximum tenacity.

EXAMPLE 3

This example describes the preparation of an approximately 8,000 denier 3.9 width-to-thickness ratio polyhexamethylene adipamide monofilament by a high productivity process in accordance with this invention.

High quality polyhexamethylene adipamide polymer is made in a continuous polymerizer having a relative viscosity of 70 and is extruded into a filament at the rate of 75 pounds per hour (34.1 kg/hour) through an obround spinneret orifice (rectangular having rounded corners 3.18×14.4 mm), is passed vertically downward through an air gap of 28¼ inches (71.8 cm), and is quenched in water at 22° C. for a distance of about 174 inches (441 cm). After water quenching, the amount of residual quench water on the filament is regulated by adjustment of air flow in an air jet so that the quantity of water on the surface of the filament is between 10 and 25% by weight water on the dry weight of the monofilament. The wet monofilament is then forwarded in sequence to a puller roll at 128.8 ypm (117.7 mpm), pretension rolls at 128.9 ypm (117.8 mpm), and feed rolls at 131 ypm (120 mpm). After the feed rolls, water is added to the monofilament by contacting the filament with felt wicks supplied at the rate of 0.8 gallon per hour (13% water added based on dry weight of the monofilament) and the filament is forwarded into a 49 cm. long steamer and treated with saturated steam at 145 psig (182° C.). The monofilament contacts a change of direction roll before entering the steamer which reduces the water on the monofilament to a relatively uniform level of about 15%. The steamer has entrance and exit steam expansion chambers connected to a vacuum source to prevent steam from leaking into the plant environment.

While still in the steamer but near the exit end, the monofilament is run through a bath about 3 cm long containing water at a temperature of about 60° C. and flowing at the rate of about four gallon per hour. The surface of the monofilament is there cooled to less than about 110° C. before leaving the steamer. The monofilament is then forwarded to an air stripper which removes most of the surface water from the filament to a level of <2% water on weight of the dry filament. The monofilament is then forwarded to the first stage draw rolls which are heated to 146° C. and running at 499 ypm (454 mpm). Under these conditions, the the draw point is within the steam expansion zone of the steamer.

The filament is then forwarded in three passes through a radiant heater of about 50 inches (127 cm) in length (per pass) at a mean temperature of about 870° C. The change-of-direction roll speeds are controlled at the following: before pass 1 at 506 ypm (463 mpm), before pass 2 at 579 ypm (532 mpm), before pass 3 at 660 ypm (609 mpm), and after pass 3 at 735 ypm (672 mpm). The monofilament is then forwarded to second-stage draw rolls running at about 750 ypm (686 mpm), let-down rolls at about 737 ypm (673 mpm) and to a wind-up package. The tension at wind-up is about 850 grams and is adjusted to give good package formation.

The product of the process is an obround cross-section monofilament of 8000 denier and the 24 hour conditioned properties are shown in Table 4.

TABLE 1

| Conditions | Example 1 10-25% Water on Fil. after quench tank and applied after feed roll Smooth Guides | Example 2 10-25% Water on Fil. after quench tank and applied after feed roll Smooth Guides | Example 2 Part I 10-25% Water on Fil. after quench tank but not applied after feed roll Smooth Guides | Example 2 Part II No water left on after quench tank nor applied after feed roll Rough Guides | Example 2 Part III No water bath in steamer Smooth Guides |
|---|---|---|---|---|---|
| Denier (Nominal) | 3000 | 4000 | 4000 | 4000 | 4000 |
| Speed, ypm | 1250 | 750 | 750 | 750 | 750 |
| Straight Tenacity, gpd | 9.25 | 9.23 | 9.20 | 8.85 | 9.1 |
| Std. Dev. (St. Ten.) | 0.12 | 0.12 | 0.21 | 0.4 | 0.5 (n = 8) |
| Knot Tenacity, gpd | 6.0 | 6.0 | 6.1 | 4.8 | 4.8 |
| Std. Dev. (Knot Ten.) | 0.50 | 0.61 | 0.46 | 1.35 | 1.4 (n = 8) |

TABLE 2

| Monofilament Denier | G 3987 | H 3981 |
|---|---|---|
| Straight Ten., gpd | 9.8 | 9.4 |
| Straight Elon., % | 18.3 | 17.9 |
| Knot Ten., gpd | 6.6 | 6.5 |
| Knot Elon., % | 14.0 | 13.7 |

TABLE 3

EFFECT OF VARYING 2nd STAGE DRAW PROFILE

| | EXAMPLE 2 | PART VA | PART VB |
|---|---|---|---|
| ROLL SPEEDS | | | |
| 1st STAGE ROLL, YPM | 488.2 | 488.2 | 488.2 |
| 2nd STAGE ROLL, YPM | 750 | 750 | 750 |
| S-1 HYDR. ROLL, YPM | 507.8 | 545.7 | 489.2 |
| S-2 HYDR. ROLL, YPM | 542.1 | 582.7 | 522.1 |
| S-3 HYDR. ROLL, YPM | 668.7 | 719.5 | 643.2 |
| MONOFILAMENT PROPERTIES | | | |
| STRAIGHT TENACITY, GPD | 9.35 | 9.0 | 9.0 |
| STRAIGHT E-BRK, % | 18.65 | 18.5 | 18.9 |
| KNOT TENACITY, GPD | 5.85 | 5.2 | 5.85 |
| KNOT E-BRK, % | 12.85 | 11.6 | 12.65 |

TABLE 4

| | |
|---|---|
| Tenacity (gpd) | 8.6 |
| Std. Dev. (n = 10) | .22 |
| Knot strength (gpd) | 5.4 |
| Modulus (gpd) | 51.0 |
| Width-to-Thickness Ratio | 3.9 |
| Cross-Section | Obround |

We claim:

1. In a process including the steps of spinning, water-quenching, and drawing a heavy denier, thermoplastic monofilament in at least first and second draw stages, the quenched monofilament being advanced in the first draw stage through a steamer containing a high temperature steam atmosphere and being advanced in the second draw stage through a zone heated with a radiant heater, the total draw ratio being at least about 5.5X, the monofilament after water quenching contacting guides and surfaces including feed rolls and thereafter entering the steamer, the improvement which comprises:

providing water on the surface of the monofilament before such contacting of said guides and surfaces in the amount of at least 10% by weight based on the dry weight of the monofilament.

2. The process of claim 1 wherein said amount of water on said monofilament is between about 10% and about 25% by weight based on the dry weight of the monofilament.

3. The process of claim 1 wherein said providing of water on said monofilament is performed by regulating residual quench water on the filaments.

4. The process of claim 3 wherein said regulating residual quench water on said filaments is performed by directing jets of air on the monofilament to adjust the residual quench water carried by the filament.

5. The process of claim 1 further comprising adding additional water to the monofilament after advancing past the feed rolls and before entering the steamer in the amount of above about 5% by weight based on monofilament dry weight.

6. The process of claim 1 further comprising adding additional water to the monofilament after advancing past the feed rolls and before entering the steamer in the amount of between about 5% and about 20% by weight on the monofilament dry weight.

7. The process of claim 6 wherein said amount of water is applied uniformly to the monofilament.

8. The process of claim 1 wherein the denier of the monofilament is above about 1000 denier.

9. The process of claim 1 wherein the throughput of the process is at least about 35 pounds per hour per monofilament.

10. In a process including the steps of spinning, water quenching in a water quench bath and drawing a heavy denier, polyamide monofilament in at least first and second draw stages, wherein in the first draw stage said quenched monofilament is orientation-stretched at a ratio of at least 3.0X by being contacted by feed rolls, advancing through a steamer having a high temperature steam heating zone containing a high temperature steam atmosphere and being contacted by first stage draw rolls, wherein said monofilament in the second draw stage is advanced through a zone heated with a radiant heater, the total draw ratio being at least about 5.5X, the improvement comprising:

adjusting the temperature of the quenched monofilament in advance of the steamer to correspond to a predetermined draw ratio so that the first stage draw point is maintained after the feed rolls and before the high temperature steam heating zone of the steamer.

11. The process of claim 10 wherein said adjusting of the temperature of the quenched monofilament is performed by adjusting the residence time of the monofilament in the quench bath.

12. The process of claim 11 wherein said adjusting of the residence time in the quench bath is performed by adjusting the length of the path of travel through the quench bath.

13. The process of claim 10 wherein said adjusting of the temperature of the quenched monofilament is performed by adjusting the temperature of the quench bath.

14. The process of claim 10 wherein said steamer has an entrance expansion zone before said high temperature steam heating zone containing a lower temperature steam atmosphere than the steam atmosphere of said high temperature steam heating zone and the temperature of said monofilament is adjusted so that said drawpoint is in said entrance steam expansion zone.

15. The process of claim 10 wherein said steamer has an entrance expansion zone before said high temperature steam heating zone containing a lower temperature steam atmosphere than the steam atmosphere of said high temperature steam heating zone and the temperature of said monofilament is adjusted so that said drawpoint is ahead of and closely adjacent to steam expansion zone.

16. In a process including the steps of spinning, water quenching in a water quench bath and drawing a heavy denier, polyamide monofilament in at least first and second draw stages, wherein in the first draw stage said quenched monofilament is orientation-stretched at a ratio of at least 3.0X by being contacted by feed rolls, advancing through a steamer having a high temperature steam heating zone containing a high temperature steam atmosphere and being contacted by first stage draw rolls, wherein said monofilament in the second draw stage is advanced through a zone heated with a radiant heater, the total draw ratio being at least about 5.5X, the improvement comprising:

adjusting the temperature of the quenched monofilament in advance of the steamer to correspond to a predetermined draw ratio so that the first stage draw point is maintained after the feed rolls and before the high temperature steam heating zone of the steamer; and providing water on said monofilament so that as said monofilament advances to said draw point, the monofilament has water on its surface in the amount of at least about 5% by weight based on the dry weight of the monofilament.

17. The process of claim 16 wherein the amount of water on the monofilament at the draw point is between about 5% and about 20% by weight based on the monofilament dry weight.

18. The process of claim 17 wherein said amount of water is applied uniformly to the monofilament.

19. The process of claim 16 wherein said steamer has an entrance expansion zone before said high temperature steam heating zone containing a lower temperature steam atmosphere than the steam atmosphere of said high temperature steam heating zone and the temperature of said monofilament is adjusted so that said drawpoint is in said entrance steam expansion zone.

20. The process of claim 15 wherein said steamer has an entrance expansion zone before said high temperature steam heating zone containing a lower temperature steam atmosphere than the steam atmosphere of said high temperature steam heating zone and the temperature of said monofilament is adjusted so that said drawpoint is ahead of and closely adjacent to steam expansion zone.

21. In a process including the steps of spinning, water-quenching and drawing a heavy denier, thermoplastic monofilament in at least first and second draw stages in which the monofilament is advanced in a first draw stage through a high temperature steam heating zone contained within a steamer having an entrance and exit seals for admitting and discharging the monofilament from the steamer while minimizing steam loss from the steamer, the monofilament surface being heated to above about 110° C. in said high temperature steam heating zone, and the monofilament being advanced in the second draw stage through a zone heated with a radiant heater, the total draw ratio being at least about 5.5X, the improvement which comprises:

cooling the monofilament surface prior to passing through said steamer exit seal by passing said monofilament through a water bath.

22. The process of claim 21 wherein said water bath has a temperature less than about 80° C.

23. The process of claim 21 wherein the denier of the monofilament is above about 1000 denier.

24. In a process including the steps of spinning, water-quenching, and drawing a heavy denier, thermoplastic monofilament in at least first and second draw stages, the monofilament being advanced in the first draw stage through a steamer containing a high temperature steam atmosphere and being advanced in the second draw stage in which the monofilament is subjected to radiant heating, the total draw ratio being at least about 5.5X, the improvement which comprises:

advancing said monofilament in the second draw stage to make at least a first pass through a heating zone for radiant heating;

contacting the monofilament with a first change of direction roll before said first pass through said radiant heating zone and contacting the monofilament with a second change of direction roll after said first pass, said monofilament contacting the surface of each of said rolls through a wrap angle of between about 75 degrees and about 200 degrees; and controlling the speed of said first and second change of direction rolls so that the tension applied to the monofilament increases as the monofilament advances past each of said rolls.

25. The process of claim 24 further comprising advancing the monofilament through a second pass through a radiant heating zone after said monofilament advances past said second change of direction roll, said first and second passes being performed successively so that the core temperature of the monofilament increases from the first pass to said second pass, and said process further comprising contacting the monofilament with a third change of direction roll after said second pass, the monofilament contacting the surface of said third roll through a wrap angle of between about 75 degrees and about 200 degrees, and controlling the speed of said third change of direction roll so that the tension on the monofilament increases as the monofilament advances past said third change of direction roll.

26. The process of claim 25 further comprising advancing the monofilament through a third pass through a radiant heating zone after said monofilament advances past said third change of direction roll, said first, second and third passes being performed successively so that the core temperature of the monofilament increases from the second pass to said third pass, and said process further comprising contacting the monofilament with a fourth change of direction roll after said third pass, the monofilament contacting the surface of said fourth roll through a wrap angle of between about 75 degrees and about 200 degrees, and controlling the speed of said fourth change of direction roll so that the tension on the monofilament increases as the monofilament advances past said third change of direction roll.

27. The process of any one of claims 24–26 wherein the speed of the first change of direction roll is controlled so that a substantial amount of draw is not imparted to the monofilament in the second draw stage until said monofilament advances to said first pass through said radiant heating zone.

28. The process of claim 24 wherein the denier of the monofilament is above about 1000 denier.

29. In a process including the steps of spinning, water-quenching and drawing a high tenacity thermoplastic monofilament having a tenacity of at least about 7.5 gpd in at least first and second draw stages in which the monofilament is advanced in the first draw stage through a steamer having a high temperature steam heating zone containing a high temperature steam atmosphere and is advanced in the second stage through a zone heated with a radiant heater, the total draw ratio being at least about 5.5X, the monofilament contacting guides and surfaces including feed rolls and thereafter entering the steamer, the improvement which comprises:

spinning said monofilament at a polymer throughput rate of at least about 35 pounds per hour per monofilament;

providing water on the surface of the monofilament before such contacting of said guides and surfaces in the amount of at least 10% by weight based on the dry weight of the monofilament; and controlling, the temperature of the quenched filament in advance of the steamer to correspond to a predetermined draw ratio so that the first stage draw point is maintained after the feed rolls and before the monofilament leaves the high temperature zone of the steamer.

30. The process of claim 29 wherein additional water is added to the monofilament after advancing past the feed rolls and before entering the steamer in the amount of above about 5% by weight based on monofilament dry weight.

31. The process of claim 29 or claim 30 wherein the temperature of the quenched filament is controlled so that the first stage draw point is maintained after the feed roll and before the high temperature zone of the steamer.

32. The process of claim 29 wherein said controlling the temperature of the quenched filament is performed by adjusting the residence time of the monofilament in the quench bath.

33. The process of claim 32 wherein said adjusting of the residence time in the quench bath is performed by adjusting the length of the path of travel through the quench bath.

34. The process of claim 29 wherein said controlling the temperature of the quenched filament is controlled by adjusting the temperature of the quench bath.

35. The process of claim 29 wherein in said second stage draw the monofilament is advanced in the second draw stage to make at least a first pass through at least one heating zone for radiant heating and said monofilament is contacted with a first change of direction roll before said first pass and with a second change of direction roll after said first pass, the monofilament contacting the surface of each of said rolls through a wrap angle of between about 75 degrees and about 200 degrees, and the speed of at least said first and second change of direction rolls is controlled so that the tension applied to the monofilament increases as the monofilament advances past each of said first and second change of direction rolls.

36. The process of claim 35 further comprising advancing the monofilament through a second pass through a radiant heating zone after said monofilament advances past said second change of direction roll, said first and second passes being performed sequentially so that the core temperature of the monofilament increases from the first pass to said second pass, and said process further comprising contacting the monofilament with a third change of direction roll after said second pass, the monofilament contacting the surface of said third roll through a wrap angle of between about 75 degrees and about 200 degrees, and controlling the speed of said third change of direction roll so that the tension on the monofilament increases as the monofilament advances past said third change of direction roll.

37. The process of claim 36 further comprising advancing the monofilament through a third pass through a radiant heating zone after said monofilament advances past said third change of direction roll, said first, second, and third passes being performed sequentially so that the core temperature of the monofilament increases from the second pass to said third pass, and said process further comprising contacting the monofilament with a fourth change of direction roll after said third pass, the monofilament contacting the surface of said fourth roll through a wrap angle of between about 75 degrees and about 200 degrees, and controlling the speed of said fourth change of direction roll so that the tension on the monofilament increases as the monofilament advances past said third change of direction roll.

38. The process of any one of claims 35–37 wherein the speed of the first change of direction roll is controlled so that a substantial amount of draw is not imparted to the monofilament in the second draw stage until said monofilament advances to said first pass through said radiant heating zone.

39. The process of claim 35 wherein the monofilament has an oblong cross-section defining a width-to-thickness ratio of greater than about 2.0 and having a width in mm of greater than about $1.22/(\text{density})^{\frac{1}{2}}$.

40. The process of claim 29 wherein said thermoplastic polymer is a polyamide.

41. The process of claim 40 wherein said polyamide is poly(hexamethylene adipamide).

42. The process of claim 29 wherein the denier of the monofilament is greater than about about 1,000.

43. In a process including the steps of spinning, water quenching in a water quench bath and drawing a heavy denier, polyamide monofilament in at least first and second draw stages, wherein in the first draw stage said quenched monofilament is orientation-stretched at a ratio of at least 3.0X by being contacted by feed rolls, advancing through a steamer containing a high temperature steam atmosphere and being contacted by first stage draw rolls, wherein said monofilament in the second draw stage is advanced through a zone heated with a radiant heater, the total draw ratio being at least about 5.5X, the improvement comprising:

providing water as a liquid to the surface of said monofilament so that as said monofilament advances to its draw point in said first draw stage, the monofilament has water on its surface in the amount of at least about 5% by weight based on the dry weight of the monofilament.

44. The process of claim 43 wherein said water on said monofilament at its draw point is in the amount of between about 5% and about 20% by weight based on the dry weight of the monofilament.

* * * * *